US005841311A

United States Patent [19]

Koike

[11] Patent Number: 5,841,311

[45] Date of Patent: Nov. 24, 1998

[54] VOLTAGE SUBTRACTER CIRCUIT, VOLTAGE AMPLIFIER CIRCUIT, VOLTAGE DIVIDER CIRCUIT AND SEMICONDUCTOR INTEGRATED CIRCUIT DEVICE

[75] Inventor: Hideharu Koike, Kawasaki, Japan

[73] Assignee: Kabushiki Kaisha Toshiba, Kawasaki, Japan

[21] Appl. No.: 56,629

[22] Filed: Apr. 8, 1998

[51] Int. Cl.[6] ..... G06G 7/42

[52] U.S. Cl. ..... 327/361; 327/360

[58] Field of Search ..... 327/355, 360, 327/361; 330/69, 253, 259, 260

[56] References Cited

U.S. PATENT DOCUMENTS

| | | | |
|---|---|---|---|
| 4,124,824 | 11/1978 | Kreinick et al. | 327/355 X |
| 4,329,656 | 5/1982 | Shaw | 330/257 |
| 5,602,504 | 2/1997 | Liu | 327/361 X |

*Primary Examiner*—Peter S. Wong

*Attorney, Agent, or Firm*—Oblon, Spivak, McClelland, Maier & Neustadt, P.C.

[57] ABSTRACT

A voltage subtracter circuit of the present invention includes a constant current source 1, a first MOS transistor pair 2, one end of which is connected to a source voltage terminal, and a second MOS transistor pair 3, one end of which is connected to the constant current source 1. A first differential input voltage is applied between the gate terminals of the first transistor pair 2, and a second differential input voltage is applied between the gate terminals of the second transistor pair 3. Output terminals V1 and V2 are connected to the connecting point between the first and second transistor pairs 2 and 3. From these nodes V1 and V2, a differential voltage between the first differential input voltage and a differential voltage proportional to the second differential input voltage is outputted. According to the present invention, this voltage subtracter circuit does not have any resistors, so that the circuit can be easily integrated and operated with high accuracy without being influenced by Vth and so forth.

18 Claims, 10 Drawing Sheets

VOLTAGE SUBTRACTER CIRCUIT, VOLTAGE AMPLIFIER CIRCUIT, VOLTAGE DIVIDER CIRCUIT AND SEMICONDUCTOR INTEGRATED CIRCUIT DEVICE

BACKGROUND OF THE INVENTION

1. Field of the Invention

The present invention relates generally to a voltage subtracter circuit for outputting a voltage depending on a difference between differential input voltages, and so forth. More specifically, the invention relates to a voltage subtracter circuit and so forth, which have a circuit construction capable of being formed on a semiconductor substrate.

2. Related Background Art

It is a basic function of an automatic control system to compare a certain physical amount with a desired amount, and to control so that a difference between both amounts becomes less than or equal to a predetermined amount. In a case where this function is accomplished in an electric way, the physical amount is replaced with a voltage, and this voltage is compared with a desired voltage to control so that the difference between these voltages becomes less than or equal to a predetermined value. The comparison between two voltages is equivalent to the derivation of the difference between the two voltages, so that it is required to provide a voltage subtracter circuit in order to derive the voltage difference.

FIG. 12 is a circuit diagram of a conventional voltage subtracter circuit. To the inverting input terminal of an operational amplifier OP, a first input voltage VA1 and a fourth input voltage VB2 are inputted via resistors 21, 22, respectively. To the non-inverting input terminal of the operational amplifier OP, a second input voltage VA2 and a third input voltage VB1 are inputted via resistors 23, 24, respectively. A resistor 25 is connected between the inverting input terminal and output terminal of the operational amplifier OP, and a resistor 26 is connected between the non-inverting input terminal and ground terminal of the operational amplifier OP.

Assuming that the values of resistance of the resistors 21 through 24 are equal to each other (assuming that the value of resistance is R1) and the values of resistance of the resistors 25 and 26 are equal to each other (assuming that the value of resistance is R2), the output voltage V0 of the operational amplifier OP can be expressed by equation (1).

$$V0 = -\frac{R2}{R1}\{(VA1 - VA2) - (VB1 - VB2)\} \quad (1)$$

As can be seen from the equation (1), the operational amplifier OP outputs a voltage, which is in proportion to a difference between a differential voltage (VA1−VA2) between the first and second input voltages and a differential voltage (VB1−VB2) between the third and fourth input voltages.

However, there is a problem in which it is difficult to form the conventional voltage subtracter circuit shown in FIG. 12 on the semiconductor substrate, because the circuit has resistors 21 through 26. That is, since the resistor of a typical integrated circuit is formed by utilizing a polysilicon layer or a diffusion layer, it is very difficult to form a high resistance in a semiconductor process. In addition, since an input current flows through the circuit of FIG. 12, this circuit can not be used for a circuit block requiring a high input resistance. Moreover, since the circuit of FIG. 12 uses the operational amplifier, this circuit is influenced by the characteristics (e.g., input offset voltage and speed of response) of the operational amplifier.

SUMMARY OF THE INVENTION

It is therefore an object of the present invention to eliminate the aforementioned problems and to provide a voltage subtracter circuit, a voltage amplifier circuit, a voltage divider circuit and a semiconductor integrated circuit device, which are capable of having a high input impedance and high accuracy, and operating in a high frequency without having any resistors, and which are not influenced by processes for producing them.

The present invention provides a voltage subtracter circuit for outputting a voltage depending on a differential voltage between a first differential input voltage which is a difference between first and second input voltages, and a second differential input voltage which is a difference between third and fourth input voltages, said voltage subtracter circuit comprising:

a first constant current source;

first and second MOS transistors, one end of which are connected to a terminal with a predetermined voltage level, respectively and which have the same electric characteristics; and third and fourth MOS transistors, one end of which are connected to said first constant current source, respectively and which have the same electric characteristics, wherein:

said first and third MOS transistors are connected in series between said terminal of the predetermined voltage level and said first constant current source, said second and fourth MOS transistors are connected in series between said terminal of the predetermined voltage level and said first constant current source, said first differential input voltage are applied between gate terminals of said first and second MOS transistors, and said second differential input voltage are applied between gate terminals of said third and fourth MOS transistors, and a differential voltage between said first. differential input voltage and a voltage proportional to said second differential input voltage are outputted from a connecting point between said first and third MOS transistors and a connecting point between said second and fourth MOS transistors.

Since the present invention applies the differential input voltage to two sets of the transistor pairs, respectively, which have the same electric characteristics, and outputs the voltage depending on the difference of the differential input voltage from the connecting points between the transistor pairs, it is unnecessary to provide with the resistors, which is indispensable in prior art. Therefore, it is possible to simplify the circuit construction, and it is easy to integrate the circuit.

Further, since the current does not flow through an input part in the circuit according to the present invention, the present invention is especially available in case the high resistance input is required. Furthermore, since it is possible to construct only by the MOS transistors and the constant current source, the circuit according to the present invention is capable of having a high input impedance and high accuracy, and operating in a high frequency without having any resistors, and which are not influenced by processes for producing them.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of a voltage subtracter circuit, a voltage amplifier circuit and a voltage divider circuit, according to the present invention, will be described in detail below.

[First Preferred Embodiment]

In the first preferred embodiment, a voltage subtracter circuit is formed by two sets of transistor pairs and a constant current source, and a voltage depending on a difference between differential input voltages inputted to the respective transistor pairs is outputted from the connecting point between each of the transistor pairs.

Figure 1:
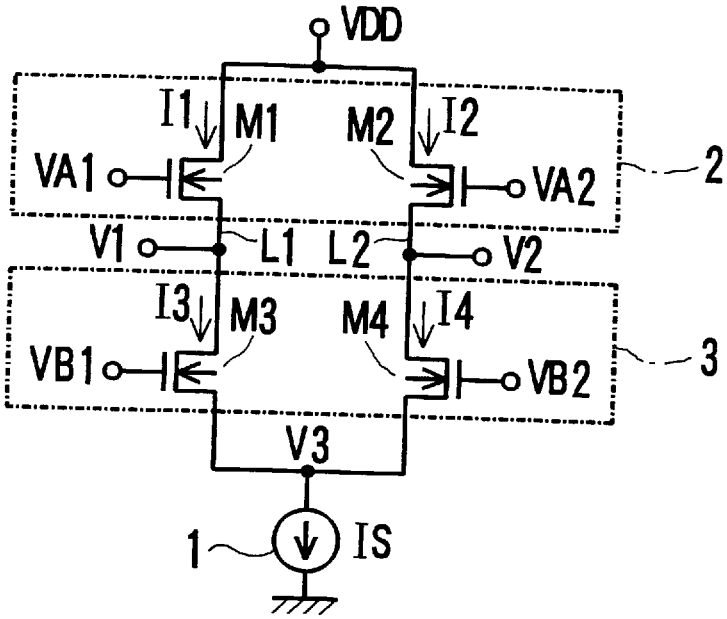
FIG. 1 is a circuit diagram of the first preferred embodiment of a voltage subtracter circuit according to the present invention.

FIG. 1 is a circuit diagram of the first preferred embodiment of a voltage subtracter circuit according to the present invention. The voltage subtracter circuit shown in FIG. 1 comprises a constant current source 1, a first transistor pair 2, one end of which is connected to a source voltage terminal VDD, and a second transistor pair 3, one end of which is connected to the constant current source 1.

The first transistor pair 2 comprises NMOS transistors M1 and M2, and the second transistor pair 3 comprises NMOS transistors M3 and M4. The NMOS transistors M1, M2 have the same electric characteristics, and the NMOS transistors M3, M4 also have the same electric characteristics. All of the NMOS transistors M1 through M4 operate in a pentode region (a saturated region).

Output terminals are connected to connecting lines L1 and L2 for connecting the first transistor pair 2 to the second transistor pair 3. In FIG. 1, it is assumed that the voltages of the output terminals are V1 and V2, respectively, the voltage of one end of the constant current voltage 1 is V3, and the voltages applied to the gate terminals of the NMOS transistors M1 through M4 are VA1, VA2, VB1 and VB2, respectively.

The difference (VA1−VA2) between the gate terminal voltages of the NMOS transistors M1 and M2 will be hereinafter referred to as a "first differential input voltage", and the difference (VB1−VB2) between the gate terminal voltages of the NMOS transistors M3 and M4 will be hereinafter referred to as a "second differential input voltage".

Currents I1, I3 flowing between the drains and sources of the NMOS transistors M1 and M3 of FIG. 1 can be expressed by equations (2) and (3).

$$I1==Kn1(VA1-Vth1-V1)^2 \tag{2}$$

$$I3=KN3(VB1-Vth3-V3)^2 \tag{3}$$

where Vth1, Vth3 are threshold voltages of the NMOS transistors M1 and M3, respectively, and Kn1 and Kn3 are current coefficients expressed by equation (4).

$$Kni=\frac{\mu Cox}{2}\ \frac{Wi}{Li} \tag{4}$$

where Li is a channel length of a NOMS transistor Mi, Wi is a channel width of the NMOS transistor Mi, $\mu$ is mobility, and Cox being capacity of a gate oxide layer per unit area.

Since the NMOS transistors M1 and M3 are connected in series, the currents I1 and I3 are equal to each other, so that equation (5) can be obtained from the equations (2) and (3).

$$V1=-\frac{\sqrt{Kn3}}{\sqrt{Kn1}}(VB1-Vth3-V3)+VA1-Vth1 \tag{5}$$

Similarly, since the currents I2 and I4 flowing through the NMOS transistors M2 and M4 are equal to each other, equation (6) can be obtained.

$$V2=-\frac{\sqrt{Kn4}}{\sqrt{Kn2}}(VB2-Vth4-V3)+VA2-Vth2 \tag{6}$$

In addition, since the electric characteristics of the NMOS transistors M1 and M2 are the same and the electric characteristics of the NMOS transistors M3 and M4 are also the same, the relationships expressed by equations (7) and (8) can be established.

$$Kn1=Kn2 \tag{7}$$

$$Kn3=Kn4 \tag{8}$$

If the body effect can be ignored, the relationships expressed by equations (9) and (10) can be established.

$$Vth1=Vth2 \tag{9}$$

$$Vth3=Vth4 \tag{10}$$

Therefore, equation (11) can be obtained from the equations (5) through (10).

$$V1 - V2 = (VA1 - VA2) - \frac{\sqrt{Kn3}}{\sqrt{Kn1}}(VB1 - VB3) \quad (11)$$

As can be seen from the equation (11), when the electric characteristics of the NMOS transistors M1 through M4 are substantially the same and when the body effect can be ignored, a voltage, which is equal to a difference between the first differential input voltage (VA1–VA2) and a differential voltage proportional to the second differential input voltage (VB1–VB2), is outputted from the connecting points between the transistor pairs 2 and 3. That is, the circuit of FIG. 1 functions as a voltage subtracter circuit.

Since the circuit of FIG. 1 comprises the NMOS transistors M1 through M4 and the constant current source 1 and does not have any resistors, this circuit is easily integrated on a semiconductor substrate. Also, since no input current flows through the circuit of FIG. 1, this circuit can be used for a circuit block requiring a high input resistance. In addition, since no operational amplifier is provided in the circuit of FIG. 1, there is no dispersion due to the characteristics (e.g., input offset and speed of response) of the operational amplifier. Moreover, since the voltage subtracter circuit is formed by the transistor pairs having the same electric characteristics, stable accuracy can be assured without being influenced by the threshold voltage Vth, mobility and so forth, even if the environmental conditions, such as temperature, are changed.

On the other hand, there is a problem in which the voltage subtracter circuit of FIG. 1 is easily influenced by the body effect. For example, in the circuit of FIG. 1, when the NMOS transistors M1 through M4 have the same electric characteristics and when the first differential input voltage (VA1–VA2) is equal to the second differential input voltage (VB1–VB2), equations (12) and (13) are established.

$$VA1 - VA2 = VB1 - VB2 \quad (12)$$

$$Kn1 = Kn3 \quad (13)$$

If the equations (12) and (13) are substituted for the equation (11), it can be seen that the voltages of the output terminals V1 and V2 of FIG. 1 are equal to each other. That is, even if the body effect for the NMOS transistors M1 through M4 can not be ignored, when the relationships expressed by the equations (12) and (13) are established and when the voltages of the output terminals V1 and V2 of FIG. 1 are equal to each other, the relationships expressed by the equations (9) and (10) are established, so that the circuit is not influenced by the body effect.

[Second Preferred Embodiment]

In the second preferred embodiment, the source terminals of NMOS transistors composing transistor pairs are connected to a substrate electrode so as not to be influenced by the body effect.

In the circuit of FIG. 1, since the electric characteristics of the NMOS transistors M3 and M4 are the same and the source terminal voltages thereof are equal to each other, even if the body effect can not be ignored, the relationship of equation (14) is established.

$$Vth3 = Vth4 \quad (14)$$

On the other hand, since the source voltages of the NMOS transistors M1 and M2 are not always equal to each other, $Vth1 \neq Vth2$ is established, in view of the influence of the body effect, so that the relationship of equation (15) is established from the equations (5) and (6).

$$V1 - V2 = (VA1 - VA2) - \frac{\sqrt{Kn3}}{\sqrt{Kn1}}(VB1 - VB2) - (Vth1 - Vth2) \quad (15)$$

Figure 2:
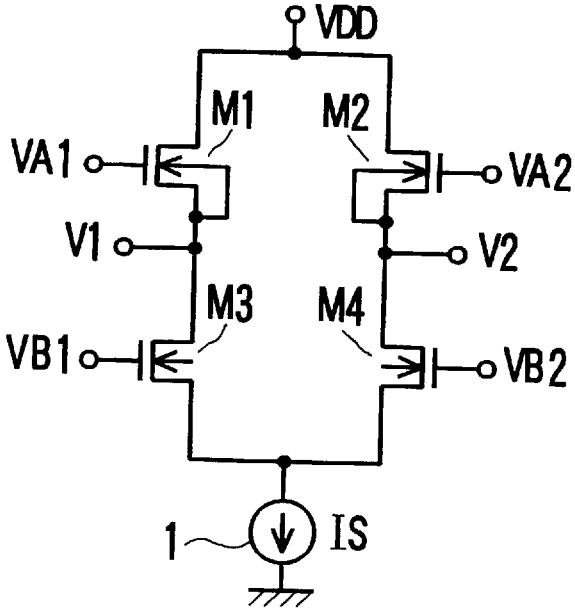
FIG. 2 is a circuit diagram of the second preferred embodiment of a voltage subtracter circuit according to the present invention.

FIG. 2 is a circuit diagram of the second preferred embodiment of a voltage subtracter circuit according to the present invention. This circuit is the same as the circuit of FIG. 1, except that the source terminals of the NMOS transistors M1 and M2 are connected to the substrate electrode. When the source terminals are connected to the substrate electrode, Vth1=Vth2 is established. If this equation is substituted for the equation (15), the same equation as the equation (10) can be obtained.

Thus, when the source terminals of the NMOS transistors M1 and M2 are connected to the substrate electrode, the influence of the body effect is ignored, so that it is possible to suppress the fluctuation in divided voltage due to the threshold voltage.

[Third Preferred Embodiment]

In the third preferred embodiment, after first differential input voltages are changed, a voltage subtracting processing is performed between the first differential input voltages and second differential input voltages.

Figure 3:
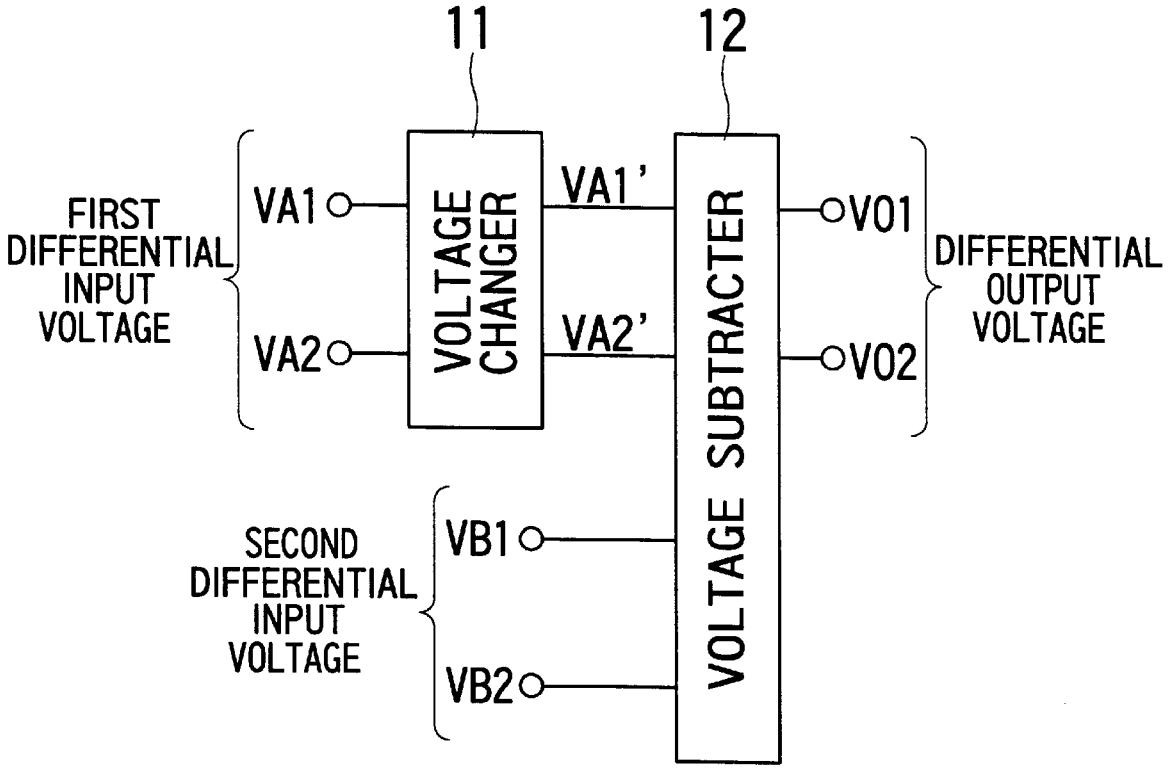
FIG. 3 is a block diagram of the third preferred embodiment of a voltage subtracter circuit according to the present invention.

FIG. 3 is a block diagram of the third preferred embodiment of a voltage subtracter circuit according to the present invention. The voltage subtracter circuit shown in FIG. 3 comprises a voltage changer 11 and a voltage subtracter 12, which has the same circuit construction as those of FIGS. 1 and 2. First differential input voltages VA1 and VA2 are inputted to the voltage changer 11, and voltages proportional to the voltages VA1 and VA2 are outputted from the voltage changer 11. The voltage subtracter 12 performs the voltage subtracting processing between the voltages VA1', VA2' outputted from the voltage changer 11 and voltages VB1, VB2 inputted from the outside.

Assuming that a proportional constant is K1, the relationship between the input and output voltages of the voltage changer 11 is expressed by equation (16).

$$VA1' - VA2' = K1(VA1 - VA2) \quad (16)$$

On the other hand, if the body effect is ignored as mentioned above, the relationship between the input and output voltages of the voltage subtracter 12 is expressed by the equation (11), so that equation (17) can be obtained from the equations (11) and (16), where K2 is a proportional constant in the equation (11).

$$V1 - V2 = (VA1' - VA2') - K2(VB1 - VB2) \quad (17)$$

If K1=K2=K is established in the equations (16) and (17), equation (18) can be obtained.

$$V1 - V2 = K\{(VA1 - VA2) - (VB1 - VB2)\} \quad (18)$$

When the equation (18) is established, the circuit of FIG. 3 functions as a voltage subtracter circuit for outputting a differential voltage, which is in proportion to a difference between the first differential input voltage (VA1–VA2) and the second differential input voltage (VB1–VB2).

In the circuits of FIGS. 1 and 2, the gate voltages VA1 and VA2 of the NMOS transistors M1 and M2 must be set to be higher than the gate voltages VB1 and VB2 of the NMOS transistors M3 and M4. On the other hand, in the circuit of FIG. 3, the gate voltages of the NMOS transistors M1 and M2 can be optionally set by the voltage changer 11, so that there is particularly no operational problem even if VA1, VA2<VB1, VB2. That is, the voltage subtracter circuit of FIG. 3 has a feature in which the variable range (dynamic range) of the input voltage is wide.

[Fourth Preferred Embodiment]

In the fourth preferred embodiment, the detailed circuit construction of the voltage changer 11 shown in FIG. 3 is shown. The portion surrounded by a dot-and-dash line in FIG. 4 corresponds to the voltage subtracter 12 having the same circuit construction as that of FIG. 1, and the portion outside of the dot-and-dash line corresponds to the voltage changer 11 shown in FIG. 3.

The voltage changer 11 has two sets of transistor pairs, which are connected in series between a source voltage terminal VDD and a constant current source 4. One of the transistor pairs comprises NMOS transistors M5 and M6, and the other transistor pair comprises NMOS transistors M7 and M8.

Figure 4:
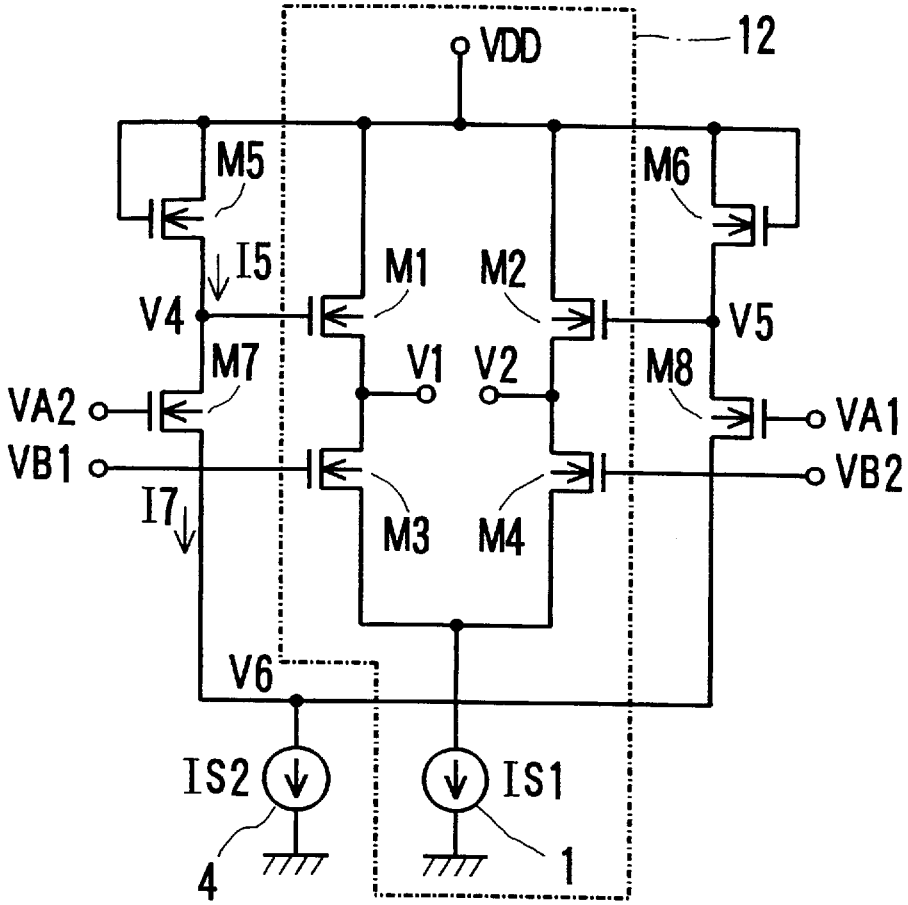
FIG. 4 is a circuit diagram illustrating the detailed construction of a voltage changer or transformer shown in FIG. 3.

In the circuit of FIG. 4, when the body effect can be ignored, the voltage between the output terminals V1 and V2 can be expressed by equation (19).

$$V1 - V2 = (V4 - V5) - \frac{\sqrt{Kn3}}{\sqrt{Kn1}}(VB1 - VB2) \tag{19}$$

That is, a differential voltage between a differential voltage (V4–V5) between a voltage V4 of the connecting point between the NMOS transistors M5, M7 and a voltage V5 of the connecting point between the NMOS transistors M6, M8 and a voltage proportional to the second differential input voltage (VB1–VB2) inputted to the respective gate terminals of the NMOS transistors M3, M4 is outputted from the output terminals V1 and V2.

If the NMOS transistors M5, M6, M7 and M8 have the same characteristics and operate in the pentode region, the currents I5, I7 flowing between the drains and sources of the NMOS transistors M5 and M7 are expressed by equations (20) and (21).

$$I5 = Kn5(VDD - Vth5 - V4)^2 \tag{20}$$

$$I7 = Kn7(VA2 - Vth7 - V6)^2 \tag{21}$$

Since the NMOS transistors M5 and M7 are connected in series, I5=I7 is established, so that equation (22) can be obtained from the equations (20) and (21).

$$V4 = VDD - \frac{\sqrt{Kn7}}{\sqrt{Kn5}}(VA2 - V6) - \left(Vth5 - \frac{\sqrt{Kn7}}{\sqrt{Kn5}}Vth7\right) \tag{22}$$

Similarly, since the currents I6 and I8 flowing through the NMOS transistors M6 and M8 are equal to each other, the relationship of equation (23) is established.

$$V5 = VDD - \frac{\sqrt{Kn8}}{\sqrt{Kn6}}(VA1 - V6) - \left(Vth6 - \frac{\sqrt{Kn8}}{\sqrt{Kn6}}Vth8\right) \tag{23}$$

If the characteristics of the NMOS transistors M5 through M8 are the same and if the body effect can be ignored, the relationships of equations (24) through (27) are established.

$$Kn5 = Kn6 \tag{24}$$

$$Kn7 = Kn8 \tag{25}$$

$$Vth5 = Vth6 \tag{26}$$

$$Vth7 = Vth8 \tag{27}$$

From these equations (24) through (27) and the equations (22) and (23), equation (28) can be obtained.

$$V4 - V5 = \frac{\sqrt{Kn7}}{\sqrt{Kn5}}(VA1 - V2) \tag{28}$$

When the equation (28) is established, the NMOS transistors M5 through M8 and the constant current source 4 are associated with each other to function as a voltage changer circuit which outputs a differential output voltage proportional to the first differential input voltage (VA1–VA2).

If the equation (28) is substituted for the equation (19), equation (29) can be obtained.

$$V1 - V2 = \frac{\sqrt{Kn7}}{\sqrt{Kn5}}(VA1 - VA2) - \frac{\sqrt{Kn3}}{\sqrt{Kn1}}(VB1 - VB2) \tag{29}$$

If the relationship of equation (30) is established, equation (31) can be obtained from the equation (29).

$$\frac{\sqrt{Kn3}}{\sqrt{Kn1}} = \frac{\sqrt{Kn7}}{\sqrt{Kn5}} \tag{30}$$

$$V1 - V2 = \frac{\sqrt{Kn3}}{\sqrt{Kn1}}\{(VA1 - VA2) - (VB1 - VB2)\} \tag{31}$$

The equation (31) indicates that a voltage proportional to a difference between the first differential input voltage (VA1–VA2) and the second differential input voltage (VB1–VB2) is outputted from the circuit of FIG. 4. Therefore, a difference between two kinds of differential input voltages can be amplified or damped to be outputted by adjusting the values of coefficients Kn1 and Kn3.

[Fifth Preferred Embodiment]

In the fifth preferred embodiment, the source terminals of some of NMOS transistors composing a voltage subtracter circuit are connected to a substrate electrode so as not to be influenced by the body effect.

Figure 5:
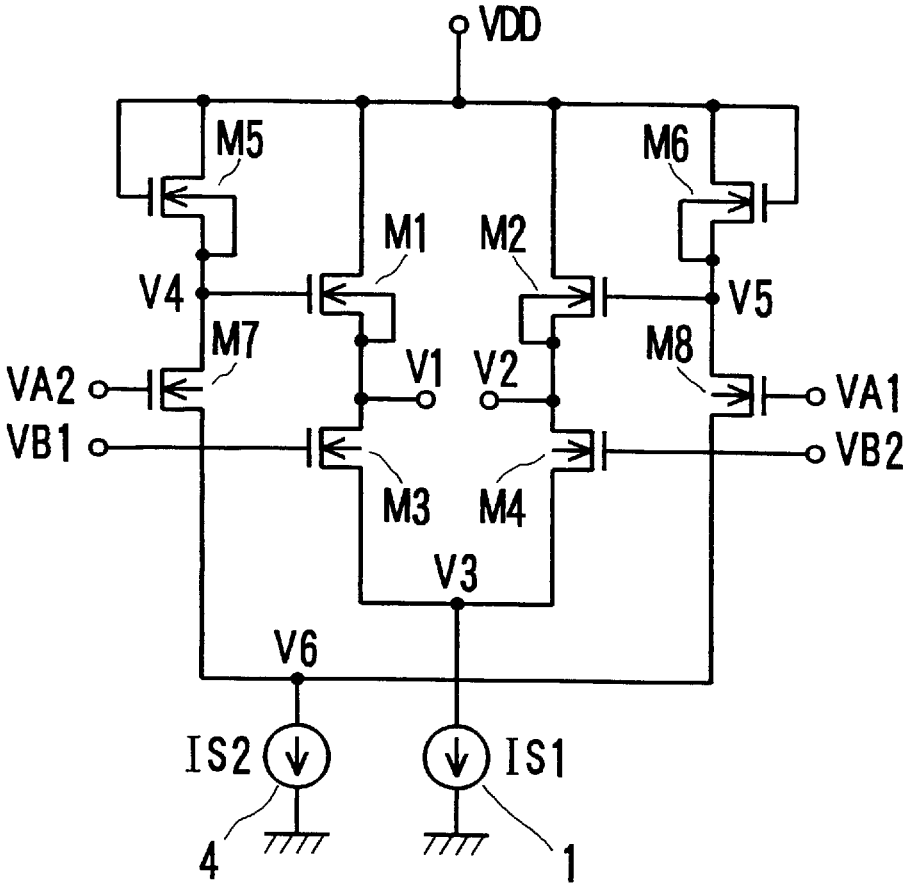
FIG. 5 is a circuit diagram of the fifth preferred embodiment of a voltage subtracter circuit according to the present invention.

FIG. 5 is a circuit diagram of the fifth preferred embodiment of a voltage subtracter circuit according to the present invention. This circuit has basically the same circuit construction as that of FIG. 4, except that the source terminals of NMOS transistors MS, M6 composing a voltage changer 11 and NMOS transistors M1, M2 composing a voltage subtracter 12 are connected to a substrate electrode. Thus, the MOS transistors M1, M2, M5 and M6 are not influenced by the body effect.

Figure 6:
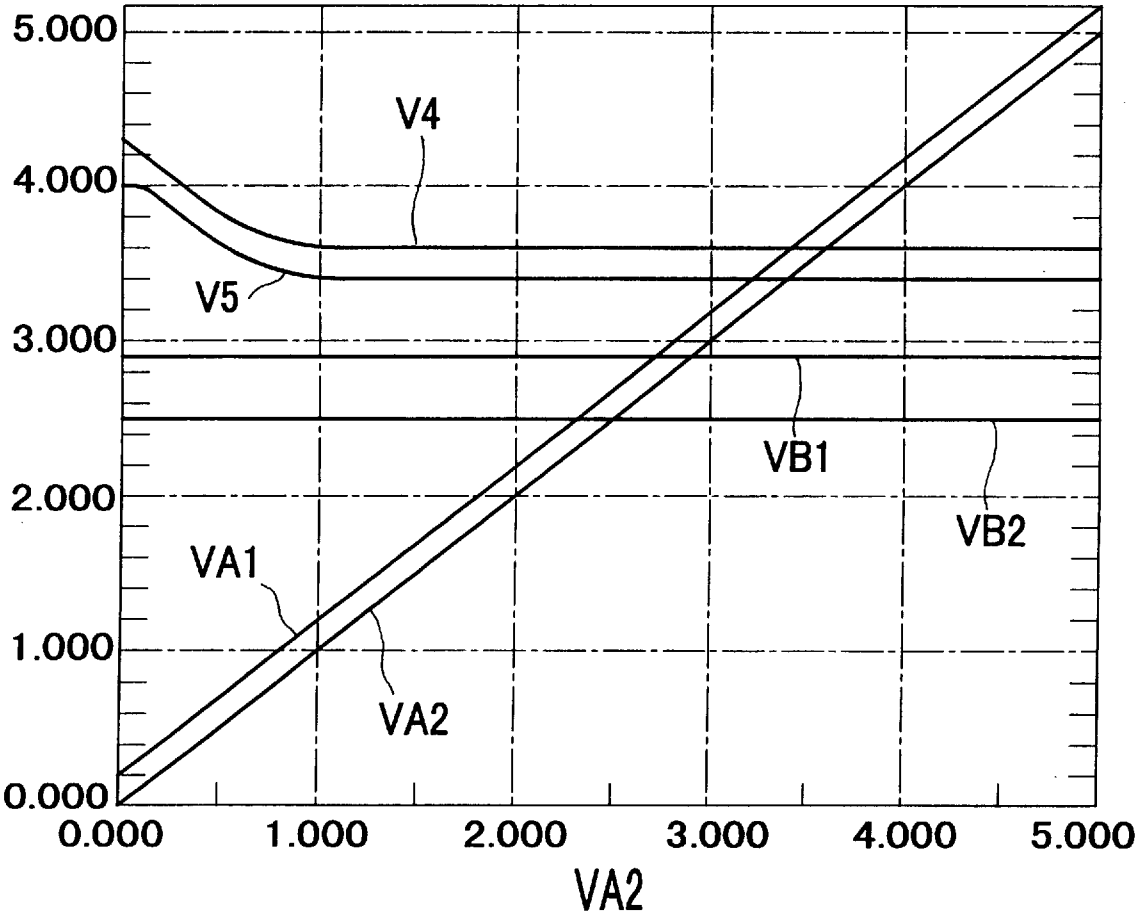
FIG. 6 is a waveform chart showing the SPICE simulated results of the voltage subtracter circuit of FIG. 5.

FIG. 6 is a waveform chart showing SPICE simulated results of the voltage subtracter circuit shown in FIG. 5. As the simulation conditions, the electric characteristics of the MOS transistors M1 through M4 and M5 through M8 were the same, and the first differential input voltage (VA1–VA2) was set to be 0.2 V, the gate voltage VB1 was set to be 2.9 V, and the gate voltage VB2 was set to be 2.5 V. The waveform chart of FIG. 6 shows fluctuation in voltages (VA1, VA2, VB1, VB2, V4, and V5) of the respective parts of the circuit of FIG. 5 when the gate voltage VA2 of the NMOS transistor M7 is changed.

As shown in FIG. 6, the difference between the voltages V4 and V5 is substantially constant, about 0.2 volts, in a region wherein the gate voltage VA2 of the NMOS transistor M7 is higher than or equal to 1 volt. That is, it can be seen that even if the voltage level of the input voltage VA1 is changed in a wide range, the output of the circuit of FIG. 5 is constant, so that the dynamic range of the input voltage is sufficiently wide.

[Sixth Preferred Embodiment]

In the sixth preferred embodiment, an instrumentation amplifier is formed by using the same voltage subtracter circuit as that of FIG. 5.

Figure 7:
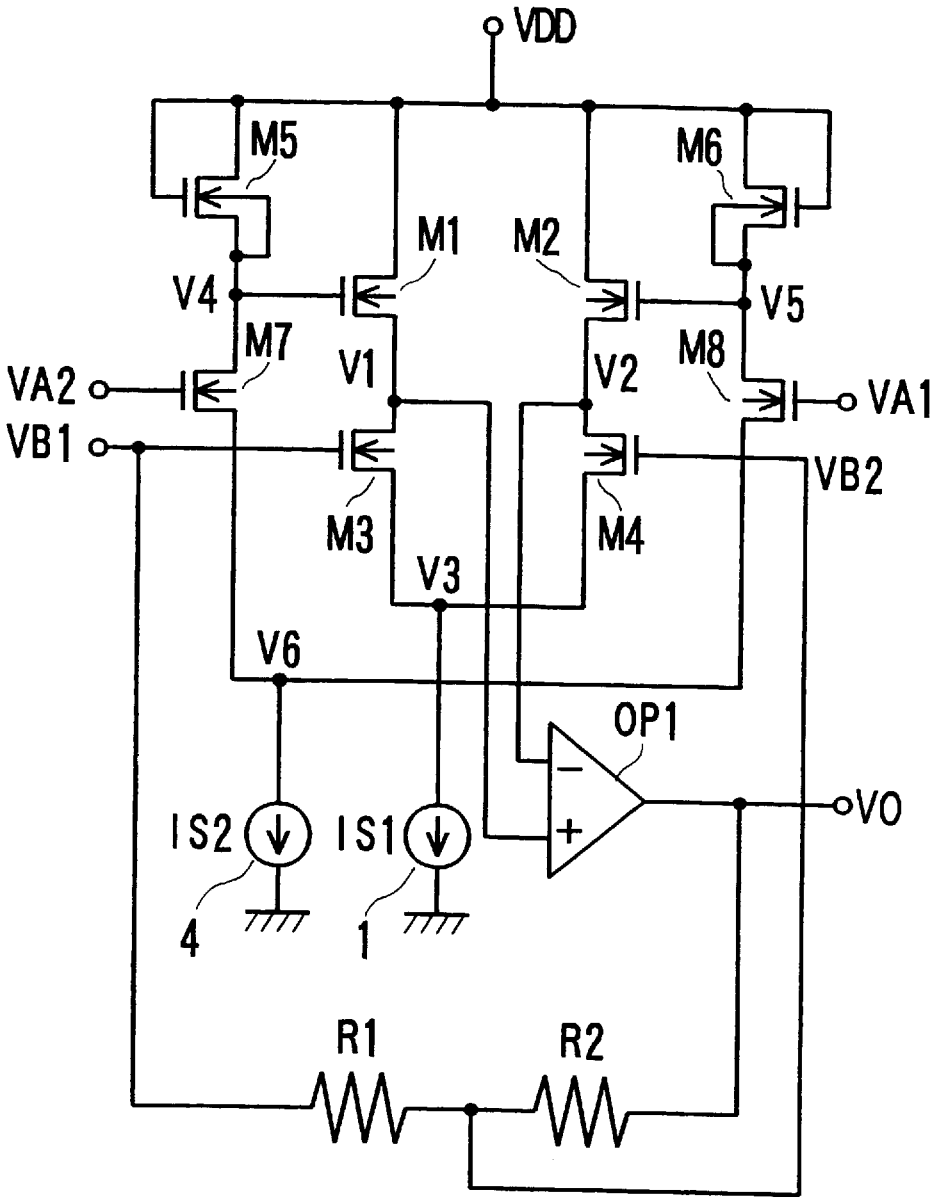
FIG. 7 is a circuit diagram of an embodiment of an instrumentation amplifier.

FIG. 7 is a circuit diagram of an embodiment of an instrumentation amplifier according to the present invention. The instrumentation amplifier of FIG. 7 is formed by adding an operational amplifier OP1 to the voltage subtracter circuit shown in FIG. 5. Specifically, the output terminals V1 and V2 of the voltage subtracter circuit are connected to the inverting input terminal and non-inverting input terminal of the operational amplifier OP1, respectively, and a voltage obtained by dividing the output of the operational amplifier OPI by resistors R1 and R2 is inputted to the gate terminal of the NMOS transistor M4.

Since the voltage difference between the output voltages V1 and V2 of the voltage subtracter circuit are always maintained to 0 volt by means of the operational amplifier OP1, the threshold voltages of the NMOS transistors M7 and M8 are always equal to each other even if the source terminals of the NMOS transistors M7 and M8 are not connected to the substrate electrode. Therefore, it can be seen from the equation (31) that the first differential input voltage (VA1–VA2) and the second differential input voltage (VB1–VB2) are always equal to each other. Assuming that the output voltage of the operational amplifier OP1 is V0, the relationship of equation (32) is established.

$$VB1 - V0 = \frac{R1 + R2}{R1}(VA1 - VA2) \tag{32}$$

It can be seen from the equation (32) that voltage V0 obtained by amplifying the first differential voltage (VA1–VA2) with an amplification gain determined by the dividing ratio for the resistors R1 and R2 is outputted from the output terminal of the operational amplifier OP1. That is, the circuit of FIG. 7 functions as an instrumentation amplifier.

The circuit of FIG. 7 has a simplified circuit construction in comparison with conventional instrumentation amplifiers. In addition, the circuit of FIG. 7 is constructed by combining the MOS transistors and does not substantially require resistors. Therefore, the circuit of FIG. 7 can be easily formed on a semiconductor substrate, and it is possible to decrease errors due to dispersion of elements. Moreover, since the circuit of FIG. 7 uses the gate terminal of the MOS transistor as an input part, it is possible to increase the input dynamic range.

[Seventh Preferred Embodiment]

In the seventh preferred embodiment, a voltage obtained by inverting a first differential input voltage is used as a second differential input voltage so that a voltage subtracter circuit functions as a voltage amplifier circuit.

Figure 8:
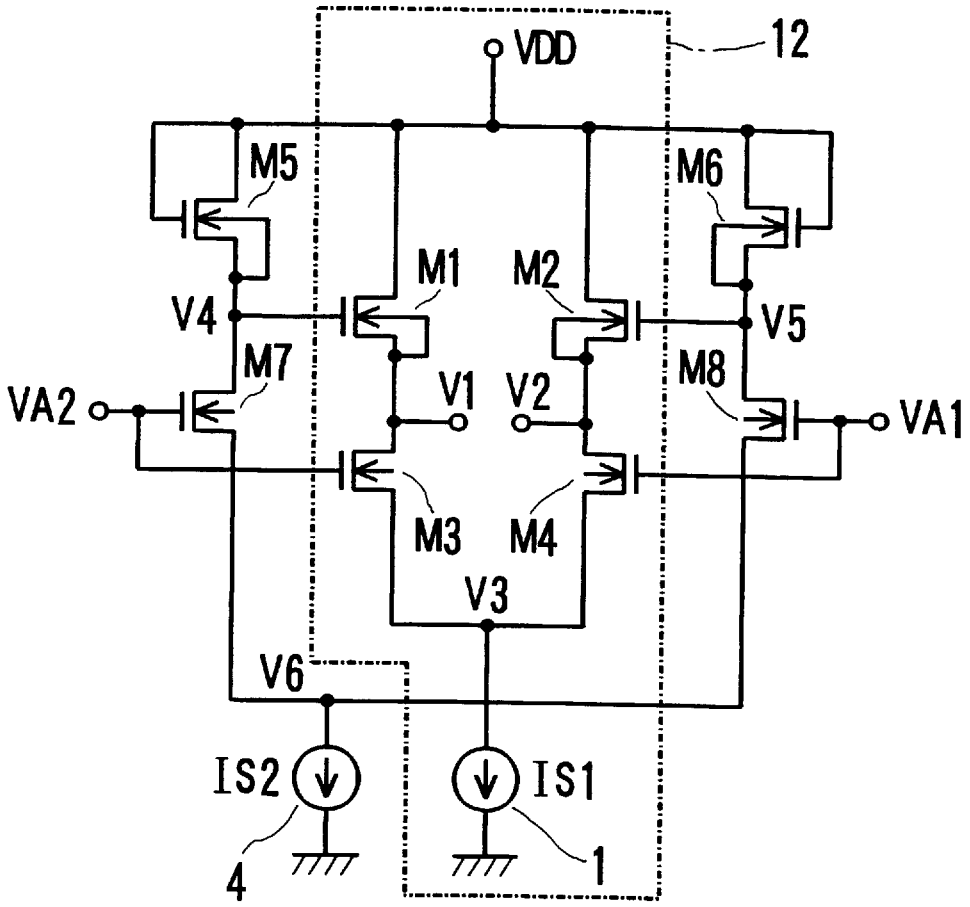
FIG. 8 is a circuit diagram of the seventh preferred embodiment of a voltage subtracter circuit according to the present invention.

FIG. 8 is a circuit diagram of the seventh preferred embodiment of a voltage subtracter circuit according to the present invention. The portion surrounded by the dot-and-dash line in FIG. 8 corresponds to a voltage subtracter 12 having the same circuit construction as that of FIG. 2. The circuit of FIG. 8 comprises NMOS transistors M5 through M8 and a constant current source 4 in addition to the voltage subtracter 12. The gate terminal of the NMOS transistor M7 is connected to the gate terminal of the NMOS transistor M3, and the gate terminal of the NMOS transistor M8 is connected to the gate terminal of the NMOS transistor M4.

For example, when the levels of the gate terminals of the NMOS transistors M3, M7 are high levels, the level of the gate terminal of the NMOS transistor M1 is a low level. On the other hand, when the levels of the gate terminals of the NMOS transistors M3 and M7 are low levels, the level of the gate terminal of the NMOS transistor M1 is a high level.

Thus, in the circuit of FIG. 8, the phase of the gate terminal of the NMOS transistor M1 is reverse to that of the gate terminal of the NMOS transistor M3. Similarly, the phase of the gate terminal of the NMOS transistor M2 is reverse to that of the gate terminal of the NMOS transistor M4.

Therefore, if the electric characteristics of all the MOS transistors M1 through M8 are the same and if the amount of current supplied from the two constant current sources 1 and 4 are equal to each other, the voltage between the output voltages V1 and V2 of FIG. 8 is expressed by equation (33).

$$V1-V2=(VA1-VA2)-(VA2-VA1)=2(VA1-VA2) \tag{33}$$

Thus, the circuit of FIG. 8 functions as a voltage amplifier circuit having an amplification gain of 2. Since the circuit of FIG. 8 comprises only the MOS transistors M1 through M8 and the constant current source 1 and does not require any resistors and capacitors, it is possible to simplify the construction of the circuit in comparison with conventional voltage amplifier circuits and it is possible to easily integrate the circuit on a semiconductor substrate. In addition, since the circuit of FIG. 8 uses the MOS transistors, it is possible to obtain a voltage amplifier circuit, which can operate at a high speed with high accuracy and which has high reliability without performing unstable oscillation operation.

While the same circuit as that of FIG. 2 has been provided in the circuit of FIG. 8, the circuit of FIG. 1 or 4 may be provided therein in replace of the circuit of FIG. 2.

[Eighth Preferred Embodiment]

In the eighth preferred embodiment, a plurality of voltage amplifier circuits for doubling a differential input voltage are connected in series.

Figure 9:
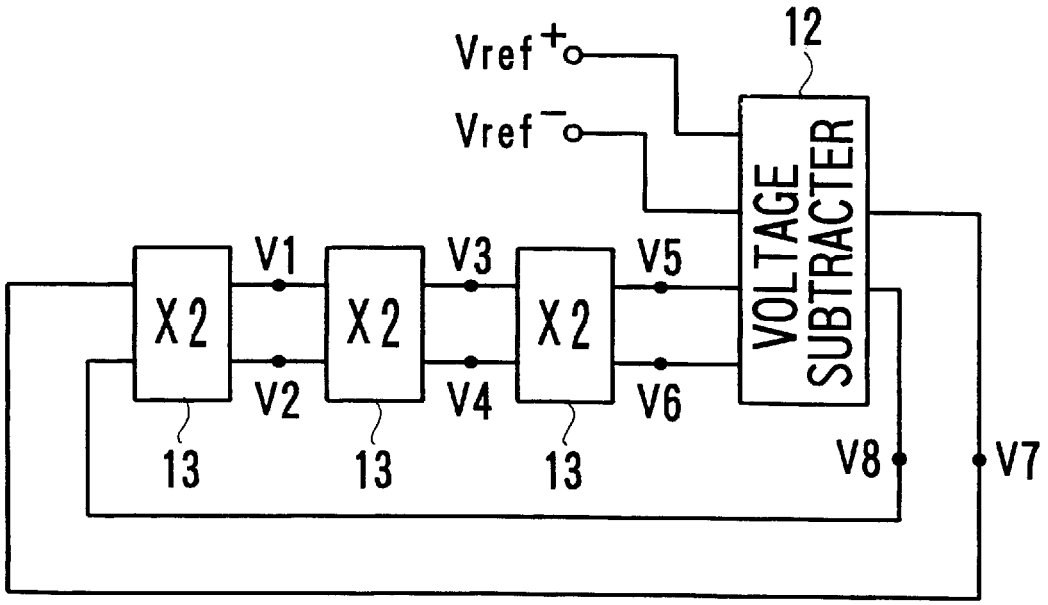
FIG. 9 is a block diagram of the eighth preferred embodiment of a voltage subtracter circuit according to the present invention.

FIG. 9 is a block diagram of the eighth preferred embodiment of a voltage subtracter circuit according to thee present invention. In the voltage subtracter circuit of FIG. 9, a plurality of voltage amplifier circuits 13 shown in FIG. 8 are connected in series, and a voltage subtracter 12 having the same circuit construction as that of FIG. 1 is connected downstream of the voltage amplifier circuit 13 in the final stage. FIG. 9 shows an example in which three stages of the voltage amplifier circuits are connected in series. Assuming that the output voltages of the respective stages are (V1, V2), (V3, V4), (V5, V6) and (V7, V8) in the order from the left in FIG. 9, the input and output voltages of the voltage amplifier circuit in the first stage are expressed by equation (34).

$$V1-V2=2(V7-V8) \tag{34}$$

Similarly, the input and output voltages of the voltage amplifier circuit in the second stage are expressed by equation (35) by utilizing the equation (34).

$$V3-V4=2(V1-V2)=2^2(V7=V8) \tag{35}$$

Similarly, the input and output voltages of the voltage amplifier circuit in the third stage are expressed by equation (36) by utilizing the equation (35).

$$V5-V6=2(V3-V4)=2^3(V7-V8) \tag{36}$$

Thus, the input and output voltages are doubled every time the number of connecting stages of the voltage amplifier circuits 13 shown in FIG. 8 is increased by 1. If n stages of voltage amplifier circuits are connected in series, the output voltage can be increased by $2^n$ as large as the differential input voltage in the first stage.

In FIG. 9, the voltage subtracter 12 is connected downstream of the voltage amplifier circuit 13 in the final stage, and the output of the voltage subtracter 12 is fed back to the input of the voltage amplifier circuit 13 in the first stage. To the voltage subtracter 12, ($Vref^+-Vref^-$) is inputted from the outside as a first differential input voltage, and the output of the voltage amplifier circuit 13 in the final stage is inputted as a second differential input voltage. The input and output voltages of the voltage subtracter 12 satisfy the relationship of equation (37).

$$V7-V8=(Vref^+-Vref^-)-(V5-V6) \quad (37)$$

From the equations (36) and (37), equation (38) can be obtained.

$$V7-V8=\frac{1}{2^3+1}(Vref^+-Vref^-) \quad (38)$$

As can be seen from the equation (38), a voltage obtained by dividing the differential input voltage ($Vref^+-Vref^-$) inputted to the voltage subtracter 12 by a value depending on the number of connection stages of the voltage amplifier circuits 13 is outputted from the voltage subtracter 12, so that it is possible to obtain a minute voltage proportional to the differential input voltage ($Vref^+-Vref^-$)

Figure 10:
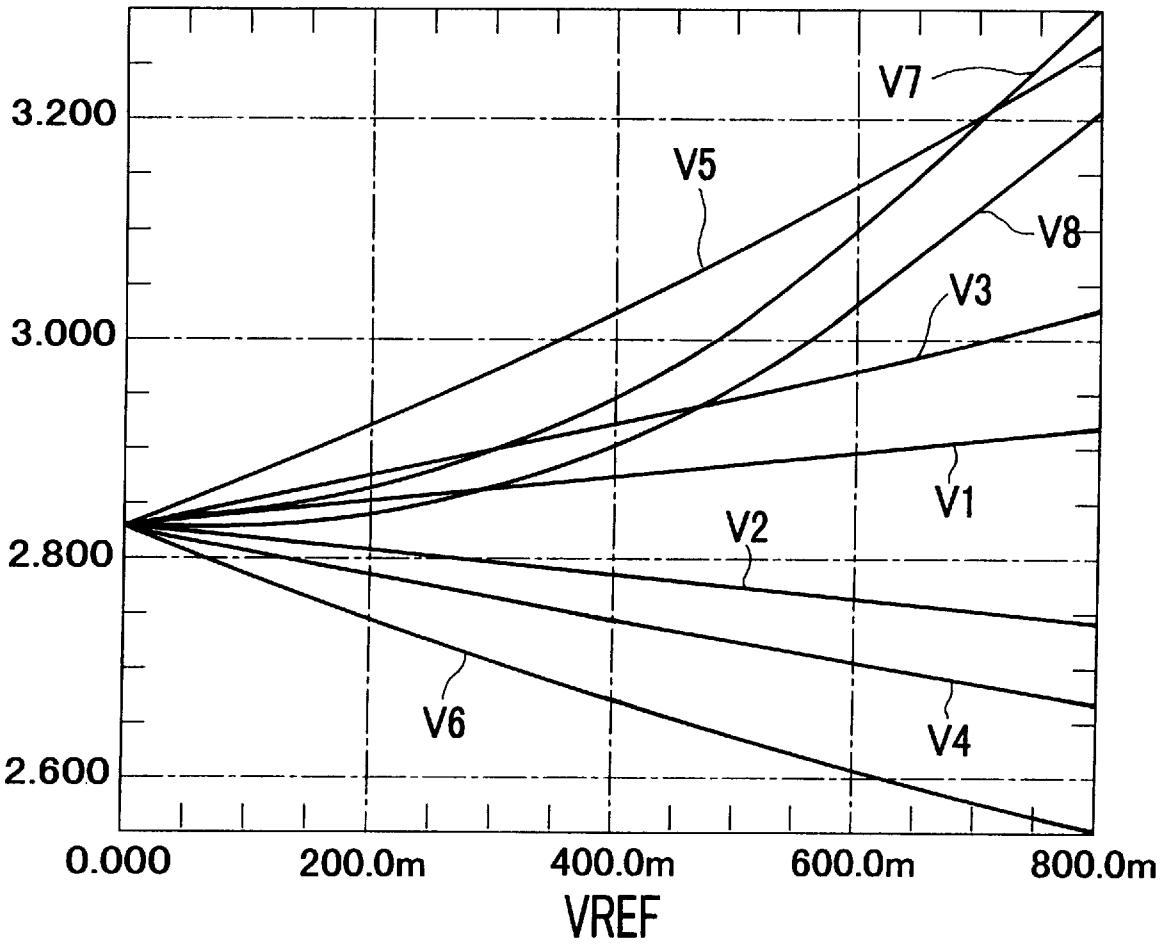
FIG. 10 is a waveform chart showing the SPICE simulated results of the voltage subtracter circuit of FIG. 9.

FIG. 10 is a waveform chart showing the SPICE simulated results of the circuit of FIG. 9. The waveform chart of FIG. 10 shows fluctuation in voltages (V1~V8) of the respective parts of the circuit of FIG. 9 when the differential input voltage ($Vref^+-Vref^-$) is changed. The horizontal axis denotes the differential input voltage $VREF=Vref^+-Vref^-$. The unit of the horizontal axis is millivolt, and the unit of the vertical axis is volt. It can be seen from FIG. 10 that if the amplitude of the differential input voltage VREF is changed, the output voltages V1, V2 are also changed substantially in proportion thereto.

In the first through eighth preferred embodiment described above, while the voltage subtracter circuit and so forth have been formed by using the NMOS transistors, a circuit may be formed by using PMOS transistors.

Figure 11:
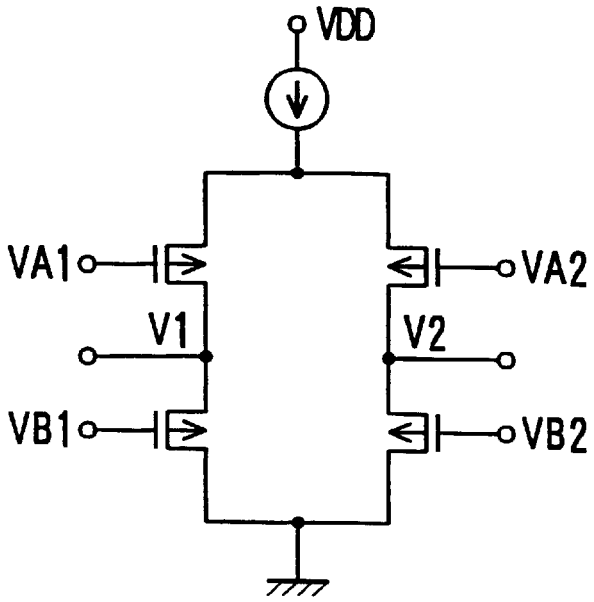
FIG. 11 is a circuit diagram of a circuit wherein NMOS transistors M1 through M4 of the voltage subtracter circuit of FIG. 1 are replaced by PMOS transistors.
Figure 12:
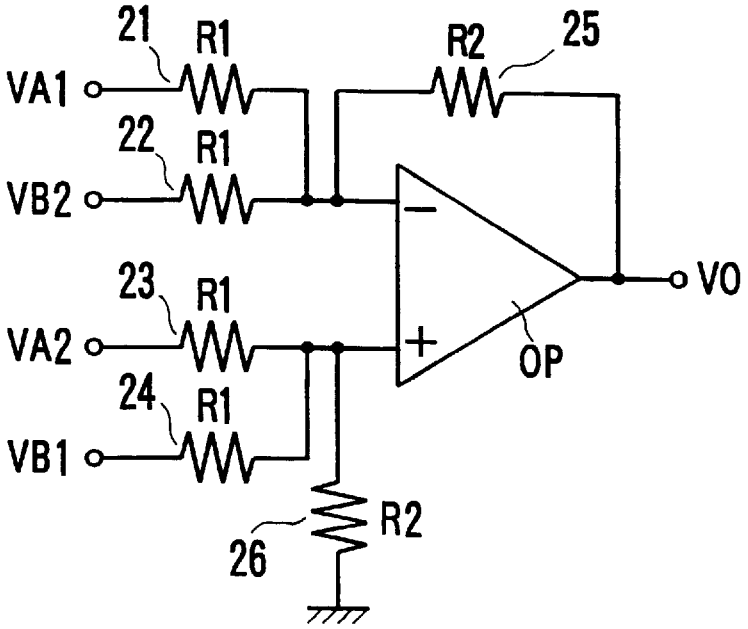
FIG. 12 PRIOR ART
FIG. 12 is a circuit diagram of a conventional voltage subtracter circuit.

For example, FIG. 11 is a circuit diagram in which the NMOS transistors M1 through M4 of the voltage subtracter circuit of FIG. 1 are replaced by PMOS transistors. As shown in FIG. 11, if the NMOS transistors M1 through M4 are replaced by the PMOS transistors M11 through M14, the connection position of the constant current source 1 is reversed, and an ground terminal, not the power supply voltage terminal VDD, is connected to the other end.

While the operational amplifier has been provided in the circuit of FIG. 7, a differential amplifier may be substituted for the operational amplifier.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention according to the appended claims.

I claim:

1. A voltage subtracter circuit for outputting a voltage depending on a differential voltage between a first differential input voltage which is a difference between first and second input voltages, and a second differential input voltage which is a difference between third and fourth input voltages, said voltage subtracter circuit comprising:

a first constant current source;

first and second MOS transistors, one end of which are connected to a terminal with a predetermined voltage level, respectively and which have the same electric characteristics; and third and fourth MOS transistors, one end of which are connected to said first constant current source, respectively and which have the same electric characteristics, wherein:

said first and third MOS transistors are connected in series between said terminal of the predetermined voltage level and said first constant current source, said second and fourth MOS transistors are connected in series between said terminal of the predetermined voltage level and said first constant current source, said first differential input voltage are applied between gate terminals of said first and second MOS transistors, and said second differential input voltage are applied between gate terminals of said third and fourth MOS transistors, and a differential voltage between said first differential input voltage and a voltage proportional to said second differential input voltage are outputted from a connecting point between said first and third MOS transistors and a connecting point between said second and fourth MOS transistors.

2. A voltage subtracter circuit according to claim 1, wherein a source terminal of said first MOS transistor is electrically connected to a substrate electrode thereof, and a source terminal of said second MOS transistor is electrically connected to a substrate electrode thereof.

3. A voltage subtracter circuit according to claim 1, wherein said second differential input voltage is a voltage obtained by inverting a phase of said first differential input voltage.

4. A voltage divider circuit comprising:

a plurality of voltage subtracter circuits, each of which comprises a voltage subtracter circuit according to claim 1 and which are connected in series so that an output of the voltage subtracter circuit in a final stage is fed back to an input of the voltage subtracter circuit in a first stage, wherein:

each of said voltage subtracter circuits in each stage other than said final stage receives an output of the voltage subtracter circuit in the preceding stage as said first differential input voltage, and receives a voltage, which is obtained by inverting a phase of said first differential input voltage, as said second differential input voltage, said voltage subtracter circuit in said final stage receives a predetermined differential input voltage as said first differential input voltage, and receives an output of the voltage subtracter circuit in the preceding stage as said second differential input voltage, and said voltage subtracter circuit in said final stage outputs a voltage obtained by decreasing a voltage amplitude of said predetermined differential input voltage in accordance with the number of stages of said voltage subtracter circuits.

5. A semiconductor integrated circuit device which comprises a voltage subtracter circuit according to claim 1, is formed on a semiconductor substrate.

6. A semiconductor integrated circuit device which comprises a voltage divider circuit according to claim 4, is formed on a semiconductor substrate.

7. A voltage subtracter circuit for outputting a voltage depending on a differential voltage between a first differential input voltage which is a difference between first and second input voltages, and a second differential input voltage which is a difference between third and fourth input voltages, said voltage subtracter circuit comprising:

a first constant current source;

first and second MOS transistors, one end of each of which is connected to a terminal with a predetermined voltage level and which have the same electric characteristics;

third and fourth MOS transistors, one end of each of which is connected to said first constant current source and which have the same electric characteristics; and a voltage changer circuit for changing said first differential input voltage into a third differential input voltage by changing voltage levels of said first and second input voltages in the same proportion, wherein:

said first and third MOS transistors are connected in series between said terminal of the predetermined voltage level and said first constant current source, said second and fourth MOS transistors are connected in series between said terminal of the predetermined voltage level and said first constant current source, said third differential input voltage is applied between gate terminals of said first and second MOS transistors, and said second differential input voltage is applied between gate terminals of said third and fourth MOS transistors, and a differential voltage between said first differential input voltage and a voltage proportional to said second differential input voltage is outputted from a connecting point between said first and third MOS transistors and a connecting point between said second and fourth MOS transistors.

8. A voltage subtracter circuit according to claim 7, wherein:

each of said first through fourth MOS transistors is an NMOS transistor, and said voltage changer circuit performs voltage conversion so that the voltage applied between said gate terminals of said first and second MOS transistors becomes higher than the voltage applied between said gate terminals of said third and fourth MOS transistors.

9. A voltage subtracter circuit according to claim 7, wherein each of said first through fourth MOS transistors is a PMOS transistor, and said voltage conversion circuit performs voltage conversion so that the voltage applied between said gate terminals of said first and second MOS transistors becomes lower than the voltage applied between said gate terminals of said third and fourth MOS transistors.

10. A voltage subtracter circuit according to claim 7, wherein said voltage changer circuit comprises:

a second constant current source;

fifth and sixth MOS transistors, one end of each of which is connected to a terminal of a predetermined voltage level and which have the same electric characteristics; and seventh and eighth MOS transistors, one end of each of which is connected to said second constant current source and which have the same electric characteristics, wherein:

said fifth and seventh MOS transistors are connected in series between said terminal of the predetermined voltage level and said second constant current source, said sixth and eighth MOS transistors are connected in series between said terminal of the predetermined voltage level and said second constant current source, gate terminals of said fifth and sixth MOS transistors are set to said predetermined voltage level, said first differential input voltage is applied between gate terminals of said seventh and eighth MOS transistors, and said third differential input voltage is outputted from a connecting point between said fifth and seventh MOS transistors and a connecting point between said sixth and eighth MOS transistors.

11. A voltage subtracter circuit according to claim 10, wherein:

a source terminal of said fifth MOS transistor is electrically connected to a substrate electrode thereof, and a source terminal of said sixth MOS transistor is electrically connected to a substrate electrode thereof.

12. A voltage subtracter circuit according to claim 7, wherein:

a source terminal of said first MOS transistor is electrically connected to a substrate electrode thereof, and a source terminal of said second MOS transistor is electrically connected to a substrate electrode thereof.

13. A voltage subtracter circuit according to claim 7, wherein said second differential input voltage is a voltage obtained by inverting a phase of said first differential input voltage.

14. A voltage divider circuit comprising:

a plurality of voltage subtracter circuits, each of which comprises a voltage subtracter circuit according to claim 7 and which are connected in series so that an output of the voltage subtracter circuit in a final stage is fed back to an input of the voltage subtracter circuit in a first stage, wherein:

each of said voltage subtracter circuits in each stage other than said final stage receives an output of the voltage subtracter circuit in the preceding stage as said first differential input voltage, and receives a voltage, which is obtained by inverting a phase of said first differential input voltage, as said second differential input voltage, wherein:

said voltage subtracter circuit in said final stage receives a predetermined differential input voltage as said first differential input voltage, and receives an output of the voltage subtracter circuit in the preceding stage as said second differential input voltage, and said voltage subtracter circuit in said final stage outputs a voltage obtained by decreasing a voltage amplitude of said predetermined differential input voltage in accordance with the number of stages of said voltage subtracter circuits.

15. A semiconductor integrated circuit device, which comprises a voltage subtracter circuit according to claim 7, is formed on a semiconductor substrate.

16. A semiconductor integrated circuit device which comprises a voltage divider circuit according to claim 14, is formed on a semiconductor substrate.

17. A voltage amplifier circuit for amplifying a differential input voltage which is a difference between two kinds of input voltages, by an amplification gain depending on a resistance ratio of first and second resistors, said voltage amplifier circuit comprising:

a differential amplifier;

a resistance divider circuit for outputting a divided voltage, which is lower than or equal to an output voltage of said differential amplifier and which is higher than or equal to a predetermined reference voltage, on the basis of said resistance ratio of said first and second resistors;

a first constant current source;

first and second MOS transistors, one end of each of which is connected to a terminal of a predetermined voltage level and which have the same electric characteristics; and third and fourth MOS transistors, one end of each of which is connected to said first constant current source and which have the same electric characteristics, wherein:

said first and third MOS transistors are connected in series between said terminal of the predetermined voltage level and said first constant current source, said second and fourth MOS transistors are connected in series between said terminal of the predetermined voltage level and said first constant current source, a voltage of a connecting point between said first and third MOS transistors is inputted to an inverting input terminal of said differential amplifier, a voltage of a connecting point between said second and fourth transistors is inputted to a non-inverting input terminal of said differential amplifier, said differential input voltage is inputted between gate terminals of said first and second MOS transistors, said reference voltage is inputted to a gate terminal of one of said third and fourth MOS transistors, and an output of said resistance divider circuit is inputted to a gate terminal of the other transistor of said third and fourth MOS transistors, and said differential amplifier outputs a voltage obtained by amplifying said differential input voltage by an amplification gain depending on the resistance ratio of said first and second resistors.

18. A semiconductor integrated circuit device, which comprises a voltage subtracter circuit according to claim 17, is formed on a semiconductor substrate.

* * * * *

UNITED STATES PATENT AND TRADEMARK OFFICE

CERTIFICATE OF CORRECTION

PATENT NO. : 5,841,311
DATED : November 24, 1998
INVENTOR(S) : Hideharu Koike

It is certified that error appears in the above-identified patent and that said Letters Patent is hereby corrected as shown below:

Title page, item [30], Foreigh Application Priority Data should be inserted to read --Apr. 8, 1997 [JP] Japan.....9-89699--

Signed and Sealed this

Eleventh Day of January, 2000

*Attest:*

Q. TODD DICKINSON

*Attesting Officer*

*Acting Commissioner of Patents and Trademarks*